US005375826A

United States Patent [19]

Flores

[11] Patent Number: 5,375,826

[45] Date of Patent: Dec. 27, 1994

[54] PAPER TRAY CONTROL OF A SHEET FEEDER HAVING BIASED NIP ROLLERS COOPERATIVE WITH THE POSITIONING OF A PAPER TRAY

[75] Inventor: Armando V. Flores, Lexington, Ky.

[73] Assignee: Lexmark International, Inc., Greenwich, Conn.

[21] Appl. No.: 137,327

[22] Filed: Oct. 15, 1993

[51] Int. Cl.[5] ..... B65H 5/00; B65H 1/00

[52] U.S. Cl. ..... 271/10; 271/274; 271/162; 271/164

[58] Field of Search ..... 271/10, 117, 119, 162, 271/164, 273, 274

[56] References Cited

U.S. PATENT DOCUMENTS

| | | | |
|---|---|---|---|
| 4,307,878 | 12/1981 | Kono | 271/22 |
| 4,387,889 | 6/1983 | Koyama et al. | 271/274 X |
| 4,583,726 | 4/1986 | Nogi et al. | 271/274 X |
| 4,610,445 | 9/1986 | Schneider et al. | 271/160 |
| 4,786,042 | 11/1988 | Stemmle | 271/9 |
| 4,966,356 | 10/1990 | Ohyabu et al. | 271/9 |
| 4,966,358 | 10/1990 | Yokoi et al. | 271/10 |
| 5,103,261 | 4/1992 | Matsuo et al. | 355/210 |

FOREIGN PATENT DOCUMENTS

| | | | |
|---|---|---|---|
| 55237 | 3/1988 | Japan | 271/162 |
| 60820 | 3/1988 | Japan | 271/10 |
| 243548 | 10/1991 | Japan | 271/162 |

*Primary Examiner*—Robert P. Olszewski
*Assistant Examiner*—Boris Milef
*Attorney, Agent, or Firm*—John A. Brady

[57] ABSTRACT

Paper tray (3) has a camming surface (60). Sets of nip rollers (22 and 24; 26 and 28) are permanent in the printer. One of set of nip roller is pivotally mounted and biased by springs (50, 56) to a follower (54). With the tray inserted, the follower is cammed to stretch the springs to apply desired nip force. The height of the cam surface may be varied to change that force for different paper contained in the tray. With the tray removed, the nip force is removed and jammed paper may be easily removed, particularly since area of the nip rollers is close to the front of the machine and near the opening left when the tray is removed.

16 Claims, 5 Drawing Sheets

PAPER TRAY CONTROL OF A SHEET FEEDER HAVING BIASED NIP ROLLERS COOPERATIVE WITH THE POSITIONING OF A PAPER TRAY

TECHNICAL FIELD

This invention relates to sheet feeding in imaging apparatus. More specifically, this invention relates to the control of sheet feeding apparatus of the imaging apparatus by the presence or absence of a paper tray in the imaging apparatus. Such control can free sheets being fed for convenient clearing of jams.

BACKGROUND OF THE INVENTION

The paper tray of this invention and the manner of active sheet feeding of this invention may be entirely conventional. It is also known to take information from a paper tray, such as paper size. Illustrative of this are U.S. Pat. No. 4,966,356 to Ohyabu et al in which grooves in a code identify the sheets in the tray and U.S. Pat. No. 4,786,042 to Stemrole in which paper-size setting changes sensor setting to the printer.

This invention employs physical camming action by the tray. U.S. Pat. No. 4,307,878 to Kono employs a camming action to adjust upward force to paper size, a function not done by this invention. U.S. Pat. No. 4,610,445 to Schneider et al employs a camming action to position a paper-lift mechanism.

This invention changes the nip force of feed rollers by control from the tray. Changing of nip force to free jams is conventional. U.S. Pat. No. 4,966,358 to Yokoi et al illustrates such moving of a press member against the biasing action of a spring. U.S. Pat. No. 5,103,261 to Matsao et al illustrates freeing paper when the lid is open.

DISCLOSURE OF THE INVENTION

An imaging apparatus has paper-feed nip rollers near the front of a paper tray receptacle and above the paper tray when installed. One of the nip rollers is rotatably mounted and biased toward separation of the nip by a spring or other resilient member. One part of the spring is attached to the roller and a separate part of the spring is attached to a rotatable member mounted to the imaging apparatus with a follower surface.

When the paper tray is extracted, the follower surface is free to move under the action of the spring. This relieves most force at the nip. This permits an operator to conveniently reach a short distance into the tray receptacle and pull out jammed paper in the feed roller. Upon insertion of the tray, a camming surface on the tray encounters the follower and causes it to rotate. The rotation expands the spring, thereby placing a strong nip force at the feed rollers. The preferred embodiment has two sets of nip rollers each connected by a spring as described, with both springs connected to one follower member.

BRIEF DESCRIPTION OF THE DRAWING

The details of this invention will be described in connection with the accompanying drawing, in which.

BEST MODE OF CARRYING OUT THE INVENTION

Figure 1:
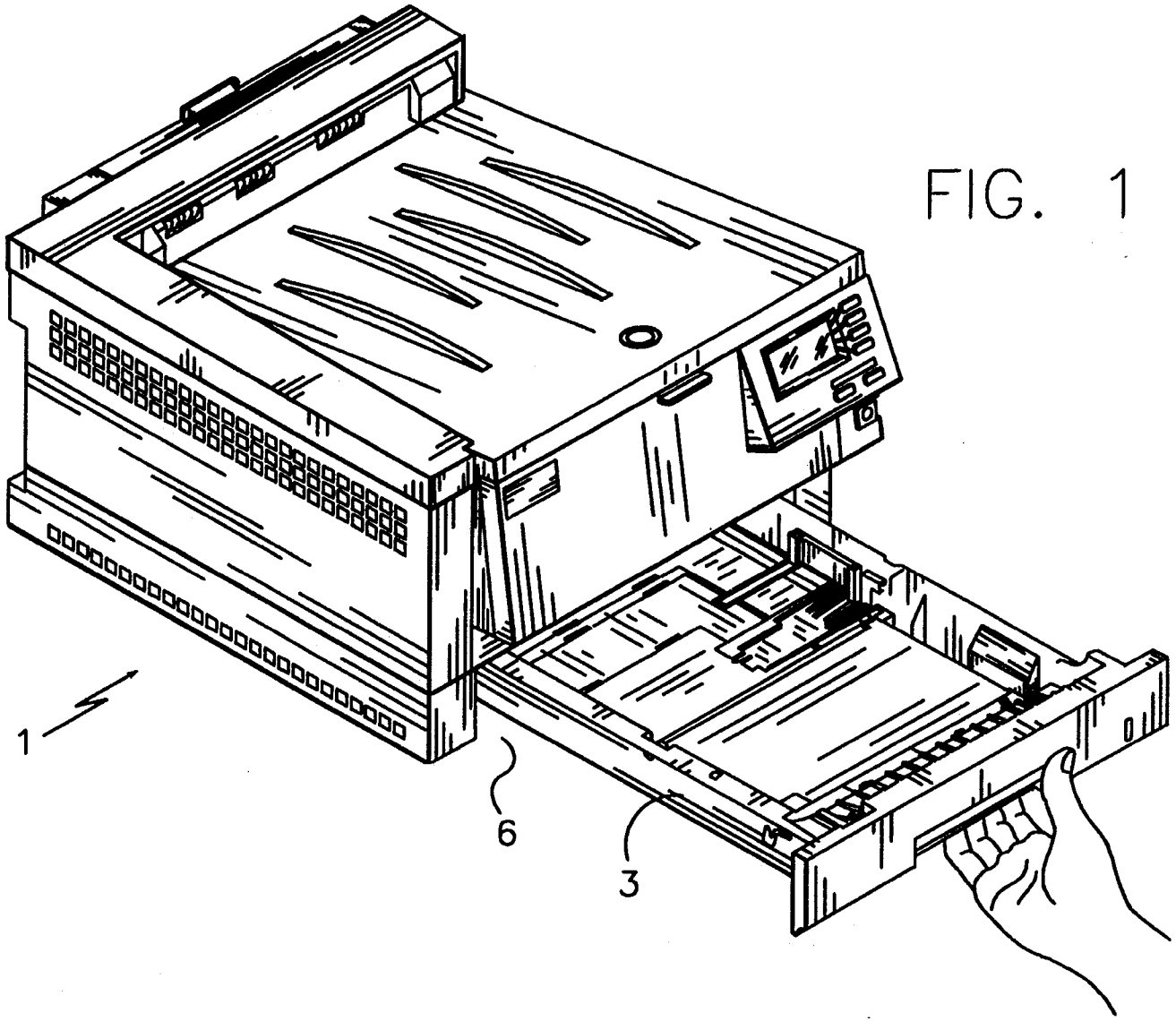
FIG. 1 shows a printer in accordance with this invention with its paper tray partially removed.

FIG. 1 shows the preferred printer 1 with the tray 3 partially removed. In use, tray 3 is fully removed to fill it with paper 5 or other substrate to be printed on. Printer 1 has an opening 6 at its front which receives tray 3.

Figure 2:
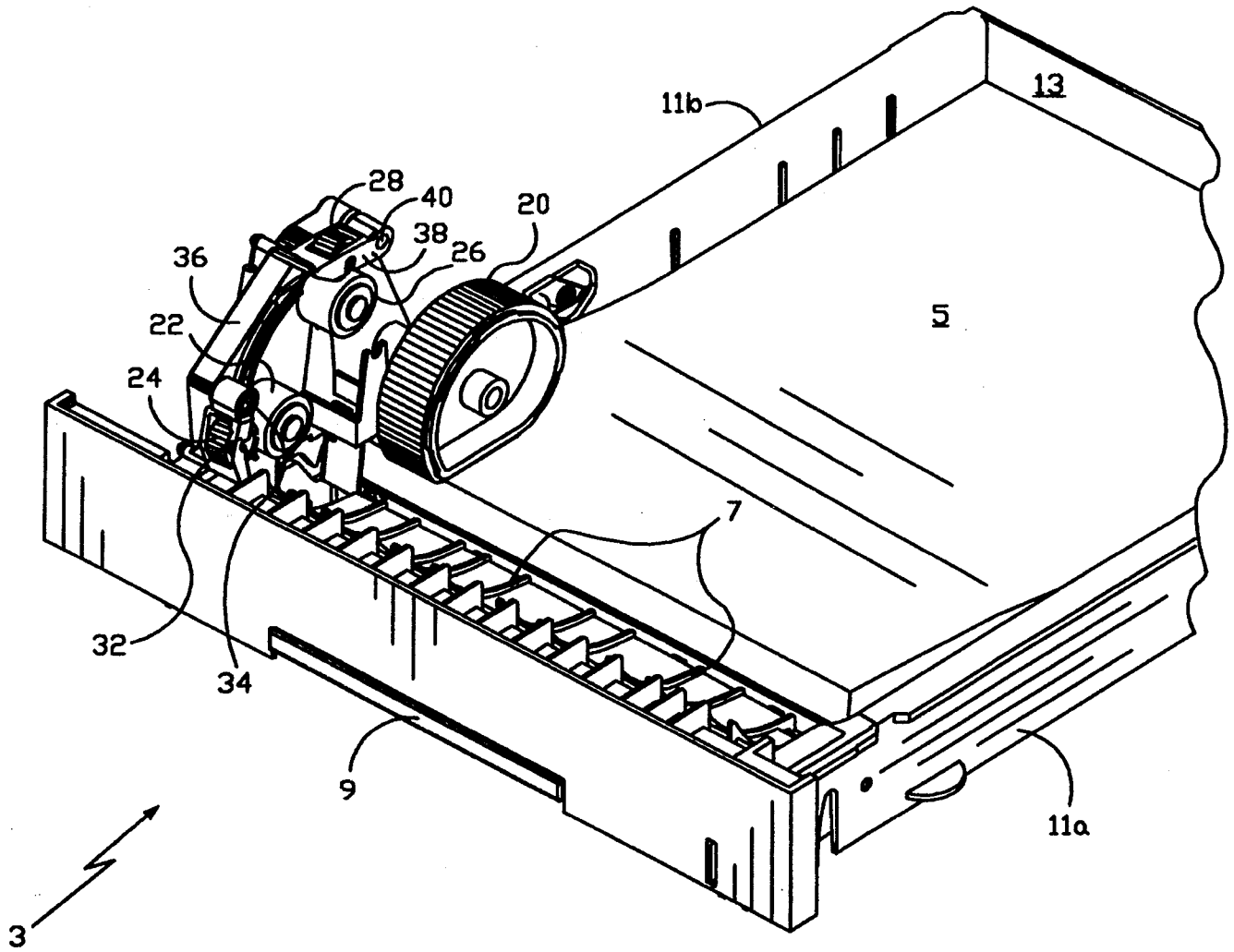
FIG. 2 is a front, top, right perspective view of the tray and paper-feed element separate from the tray.

As shown in FIG. 2 tray 3 carrying paper 5 has a front, curved guide surface 7 which is integral with tray 3. Tray 3 has a handle 9 for manually pulling tray 3 forward, and it has left and right side walls 11 a, 11 b and end wall 13 which form a receptacle for paper 5.

Separate from tray 3 and mounted permanently in printer 1 are the D roller 20, the driver roller 22, in nip relationship with back-up roller 24 and the drive roller 26 in nip relationship with back-up roller 28. Back-up roller 24 is mounted in a bracket 32 which is pivoted on pin 34 fixed to frame plate 36. Similarly, backup roller 28 is mounted in a bracket 38 which is pivoted on pin 40 fixed frame plate 36.

With tray 3 installed as shown in FIG. 2, paper feed is entirely conventional. D roller 20 makes one revolution which scrapes the top sheet of paper 5 forward into guides 7, which direct paper 5 into the nip of rollers 22 and 24. Roller 24 is driven during paper feed. Roller 24 is canted approximately 5 degrees toward frame plate 36 to align paper 5 against frame plate 36. Similarly, roller 26 is driven during paper feed, and roller 28 is canted approximately 5 degrees toward frame plate 36 for alignment of paper 5.

Figure 3:
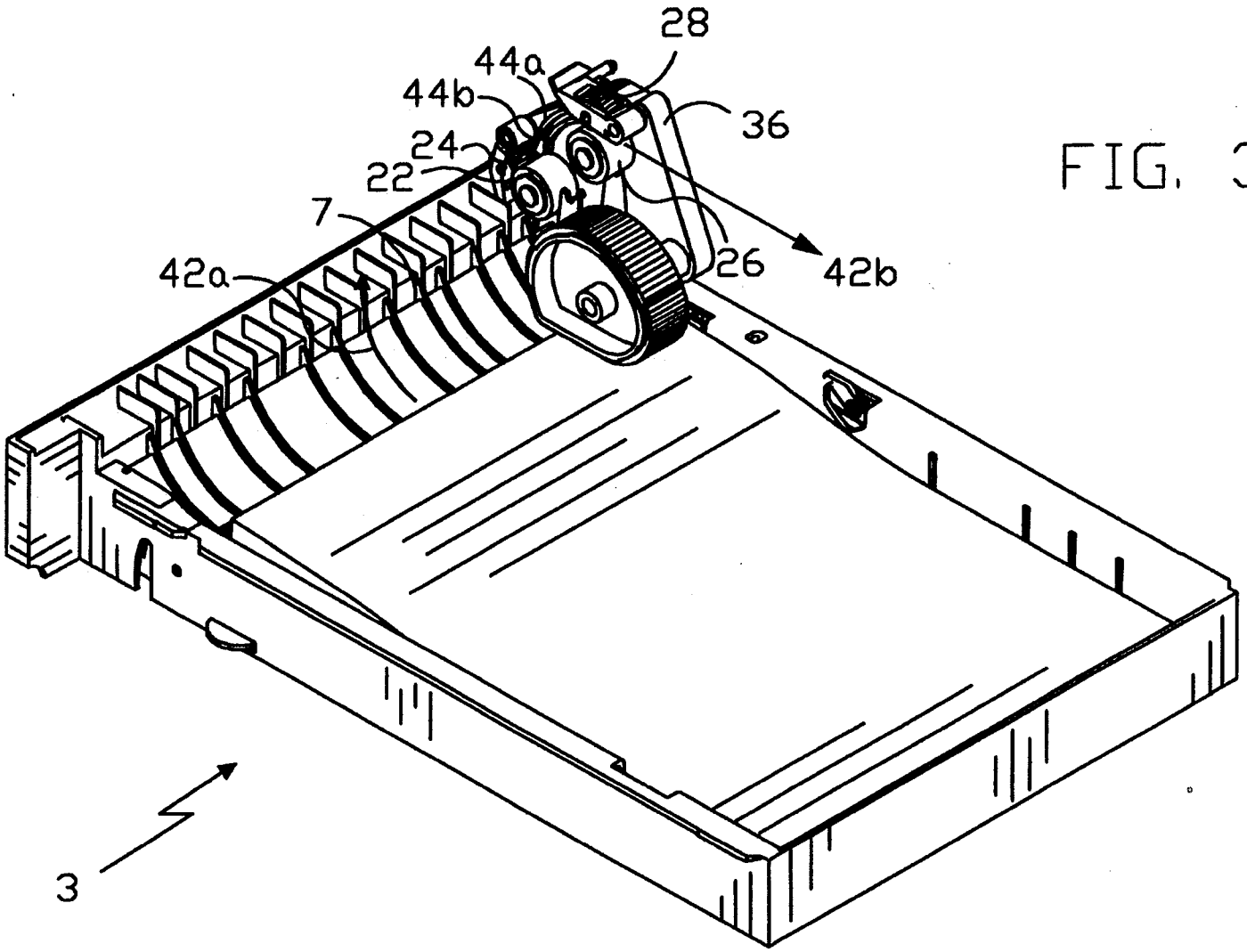
FIG. 3 is a back, top, right perspective view of the same elements as FIG. 2.

FIG. 3 shows tray 3 from a rear perspective with arrow 42*a* showing the initial movement of paper 5 forward and upward, where it is captured by nip rollers 22 and 24, guided by guide ridges 44*a* and 44*b* in frame plate 36 to enter the nip of rollers 26 and 28, where it is then moved rearwardly as shown by arrow 42*b*.

Figure 4:
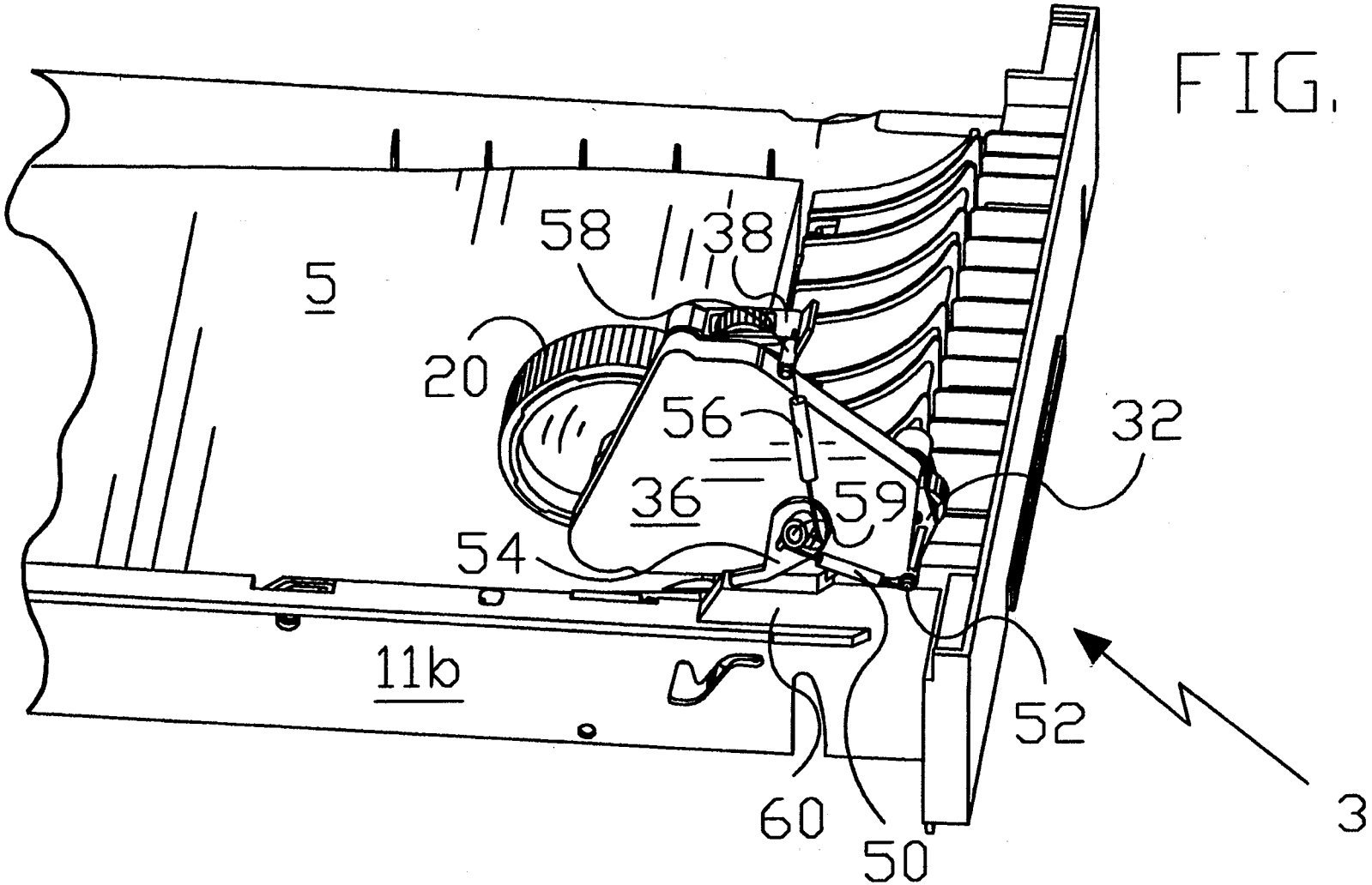
FIG. 4 is a left, top, side view showing elements hidden by the perspective of FIG. 2 and FIG. 3.

FIG. 4 shows a conventional coil spring 50 connecting an extension 52 of bracket 32 to follower member 54. Similarly a conventional coil spring 56 connects an extension 58 of bracket 38 to follower 54. Follower 54 is pivoted to frame plate 36 on pin 59. Side wall 11 b has a raised surface 60 near the front of tray 3 on which follower 54 first rotates as tray 3 is inserted and then rests on the top of surface 60 when tray 3 is fully inserted.

Rotation of follower 54 to rest on surface 60 extends springs 50 and 56, which tensions brackets 32 and 38 respectively. Since bracket 32 and 38 are mounted to pivot on pins 34 and 40 respectively, the nip force at the nip of rollers 22 and 24 is increased and the nip force at the nip of rollers 26 and 28 is increased.

Figure 5:
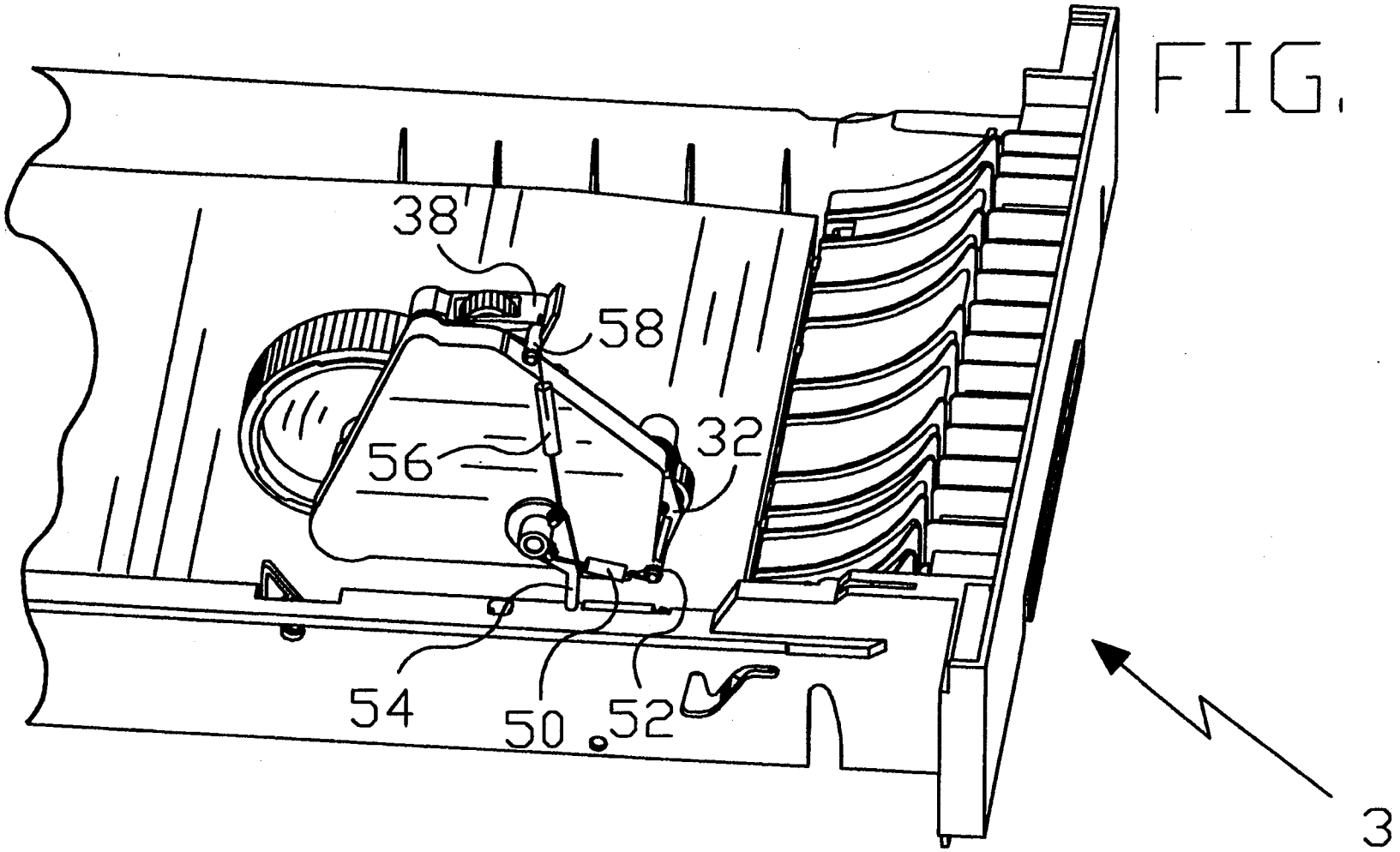
FIG. 5 is a side view of the paper feed elements with the paper partially extracted.

Conversely, as shown in FIG. 5, when tray 3 is not in printer 1, springs 50 and 56 move follower 54 counterclockwise, and the force at the nip of rollers 22 and 24 and at the nip of rollers 26 and 28 becomes virtually zero. With low force at those nip rollers, paper may be readily extracted by hand should it be jammed during operation. Since those nip rollers are close to the front of printer 1, clearance of paper jams occurring near the tray 3 is particularly convenient.

Additionally, the height of cam surface 60 may be different for trays carrying different papers. That changes the tensions at the nip of rollers 22 and 24 and at the nip of rollers 26 and 28. The alignment forces for aligning paper to an edge require high forces for heavy stock and light forces for light stock. The heavy forces are required because the stiffness of the paper induces a high drag caused by the paper path. However, high forces would tend to crush the edge of the lighter paper because of its flimsiness. This invention allows the ability to feed a wide arrangement of paper by the amount of rotation of follow 54. Different trays may be used or a single tray may be used in which the height of cam 60 can be manually selected.

Variations within the spirit and scope of this invention are anticipated.

What is claimed is:

1. An imaging apparatus comprising paper feed means comprising at least one set of nip rollers, at least one of said nip rollers being pivotally mounted, a resilient member attached to said pivotally mounted nip roller and attached to a follower member pivoted to said imaging apparatus, said resilient member extending between said pivotally mounted nip roller and said follower member, contraction of said resilient member being in the direction to reduce the force at said nip, a paper tray which may be extracted and positioned in a receptacle of said imaging apparatus, and a camming surface on said paper tray located to cam said follower member when said tray is positioned in said imaging apparatus to expand said resilient member to increase the force at said nip, said follower member being pivoted by said resilient member when said paper tray is extracted to reduce the force at said nip so that paper in said nip may be readily extracted by hand.

2. The imaging apparatus as in claim 1 in which said at least one set of nip rollers is located near the front of said imaging apparatus and near said receptacle.

3. The imaging apparatus of claim 2 in which said at least one set of nip rollers is located near the front of said imaging apparatus and generally above said receptacle.

4. The imaging apparatus of claim 1 in which said at least one set of nip rollers is located near the front of said imaging apparatus and generally above said receptacle.

5. The imaging apparatus of claim 4 in which said imaging apparatus comprises at least two sets of said nip rollers, each having a said resilient member and said resilient member of each of said two sets is attached to the same said follower member.

6. The imaging apparatus of claim 1 in which said imaging apparatus comprises at least two sets of said nip rollers, each having a said resilient member and said resilient member of each of said two sets is attached to the same said follower member.

7. The imaging apparatus of claim 2 in which said imaging apparatus comprises at least two sets of said nip rollers, each having a said resilient member and said resilient member of each of said two sets is attached to the same said follower member.

8. The imaging apparatus of claim 3 in which said imaging apparatus comprises at least two sets of said nip rollers, each having a said resilient member and said resilient member of each of said two sets is attached to the same said follower member.

9. The imaging apparatus of claim 8 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

10. The imaging apparatus of claim 1 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

11. The imaging apparatus of claim 2 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

12. The imaging apparatus of claim 3 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

13. The imaging apparatus of claim 4 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

14. The imaging apparatus of claim 5 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

15. The imaging apparatus of claim 6 in which said paper tray is selectable from at least a first set and a second set of paper trays, said first set of paper trays having one camming surface and said second set of paper trays having a different camming surface from said one camming surface to have at least two said camming surfaces to vary said nip force in relation to the difference of said camming surfaces.

16. The imaging apparatus of claim 7 in which said paper tray is selectable from at least a first set and a second set of paper trays, said first set of paper trays having one camming surface and said second set of paper trays having a different camming surface form said one camming surface to have at least two said camming surfaces to vary said nip force in relation to the difference of said camming surfaces.

* * * * *